US009631499B2

(12) United States Patent
Liang

(10) Patent No.: US 9,631,499 B2
(45) Date of Patent: Apr. 25, 2017

(54) TURBINE AIRFOIL COOLING SYSTEM FOR BOW VANE

(71) Applicant: Siemens Aktiengesellschaft, München (DE)

(72) Inventor: George Liang, Palm City, FL (US)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 15/119,084

(22) PCT Filed: Mar. 5, 2014

(86) PCT No.: PCT/US2014/020555
§ 371 (c)(1),
(2) Date: Aug. 15, 2016

(87) PCT Pub. No.: WO2015/134005
PCT Pub. Date: Sep. 11, 2015

(65) Prior Publication Data

US 2016/0362986 A1 Dec. 15, 2016

(51) Int. Cl.
*F01D 5/18* (2006.01)
*F01D 9/04* (2006.01)
*F01D 25/12* (2006.01)

(52) U.S. Cl.
CPC ..... *F01D 5/187* (2013.01); *F01D 9/041* (2013.01); *F01D 25/12* (2013.01);
(Continued)

(58) Field of Classification Search
CPC ..... F01D 5/187; F01D 25/12; F01D 9/041; F05D 2260/201; F05D 2250/185;
(Continued)

(56) References Cited

U.S. PATENT DOCUMENTS 5,660,524 A 8/1997 Lee et al.
5,716,192 A * 2/1998 Phillips ..... F01D 5/187 415/115

(Continued)

FOREIGN PATENT DOCUMENTS

EP 1947295 A1 7/2008
GB 1012899 A 12/1965

OTHER PUBLICATIONS

PCT International Search Report and Written Opinion mailed Dec. 12, 2014 corresponding to PCT Application PCT/US2014/020555 filed Mar. 5, 2014. (11 pages).

*Primary Examiner* — Craig Kim
*Assistant Examiner* — Eldon Brockman

(57) ABSTRACT

A cooling system (10) for a turbine airfoil (12) of a gas turbine engine, wherein the airfoil (12) has a bowed configuration is disclosed. The airfoil (12) may be configured such that the leading edge (16) or trailing edge (18), or both, may have midsections that are positioned further upstream than outer ends of the leading and trailing edges (16, 18). One or more cooling channels (28) of the cooling system (10) may have a larger cross-sectional area proximate to an end of the airfoil (12) than at a midspan location. One or more cooling channels (28) may have one or more corner blockers (30) that extend chordwise in the cooling channel (28) and extend from a corner (54) toward a centerline axis (34), thereby reducing a cross-sectional area of the cooling channel (28). The corner blockers (30) may be positioned within the cooling system (10) to maintain the flow of cooling fluids through the airfoil (12) within desired design parameters.

14 Claims, 7 Drawing Sheets

(52) U.S. Cl.
CPC ..... *F05D 2220/32* (2013.01); *F05D 2240/12* (2013.01); *F05D 2240/30* (2013.01); *F05D 2250/185* (2013.01); *F05D 2260/201* (2013.01); *F05D 2260/2214* (2013.01); *F05D 2260/22141* (2013.01)

(58) Field of Classification Search
CPC ..... F05D 2260/22141; F05D 2240/12; F05D 2220/32; F05D 2240/30; F05D 2260/2214
See application file for complete search history.

(56) References Cited

U.S. PATENT DOCUMENTS 5,813,836 A 9/1998 Starkweather
6,206,638 B1 3/2001 Glynn et al.
6,241,466 B1 6/2001 Tung et al.
6,422,811 B1 7/2002 Beeck et al.
6,607,356 B2 8/2003 Manning et al.
7,413,407 B2 8/2008 Liang
7,435,053 B2 10/2008 Liang
7,527,474 B1 5/2009 Liang
7,918,647 B1 4/2011 Liang
8,016,563 B1 9/2011 Liang
8,057,183 B1 * 11/2011 Liang ..... F01D 5/187 416/96 A
8,070,441 B1 12/2011 Liang
8,177,507 B2 5/2012 Pietraszkiewicz et al.
8,257,035 B2 9/2012 Schilp
8,602,735 B1 * 12/2013 Liang ..... F01D 5/186 416/97 R
8,628,294 B1 * 1/2014 Liang ..... F01D 5/187 415/115
2005/0095119 A1 5/2005 Liang
2007/0231138 A1 10/2007 Levine et al.
2011/0038735 A1 2/2011 Liang et al.
2012/0063908 A1 3/2012 Islam et al.

* cited by examiner

TURBINE AIRFOIL COOLING SYSTEM FOR BOW VANE

PRIORITY CLAIM AND CROSS-REFERENCE TO RELATED APPLICATIONS

This application is the U.S. National Stage of the International Application No. PCT/US2014/020555 filed Mar. 5, 2014, which is herein incorporated by reference in its entirety.

FIELD OF THE INVENTION

This invention is directed generally to turbine airfoils, and more particularly to cooling systems in hollow turbine vanes.

BACKGROUND

Typically, gas turbine engines include a compressor for compressing air, a combustor for mixing the compressed air with fuel and igniting the mixture, and a turbine blade assembly for producing power. Combustors often operate at high temperatures that may exceed 2,260 degrees Fahrenheit. Typical turbine combustor configurations expose turbine vane assemblies, as shown in FIGS. 1 and 3, to these high temperatures. As a result, turbine vanes must be made of materials capable of withstanding such high temperatures. In addition, turbine vanes often contain cooling systems for prolonging the life of the vanes and reducing the likelihood of failure as a result of excessive temperatures.

Typically, turbine vanes are formed from an airfoil having an inner diameter (ID) platform at an inboard end and having an outer diameter (OD) platform at the outboard end. The vane is ordinarily includes a leading edge and a trailing edge with inner aspects of most turbine vanes typically containing an intricate maze of cooling channels forming a cooling system. The cooling channels in a vane typically receive air from the compressor of the turbine engine and pass the air through the vane. The cooling channels often include multiple flow paths that are designed to maintain all aspects of the turbine vane at a relatively uniform temperature. Providing adequate cooling to turbine vanes having large cross-sectional flow areas at the ID and OD has proven challenging.

SUMMARY OF THE INVENTION

A cooling system for a turbine airfoil of a gas turbine engine, wherein the turbine airfoil has a bowed configuration is disclosed. The turbine airfoil may be configured such that the leading edge or trailing edge, or both, may have outer ends of the leading and trailing edges that are positioned further in an upstream direction than midsections. One or more cooling channels of the cooling system may have a larger cross-sectional area proximate to an end of the airfoil than at a midspan location. One or more cooling channels may have one or more corner blockers that extend chordwise in the cooling channel and extend from a corner toward a centerline axis, thereby reducing a cross-sectional area of the cooling channel. The corner blockers may be positioned within the cooling system to maintain the flow of cooling fluids through the airfoil within desired design parameters.

The turbine airfoil may be formed from a generally elongated hollow airfoil include an outer wall having a leading edge, a trailing edge, a pressure side, a suction side, an inner diameter platform at a first end of the airfoil and an outer diameter platform at a second end opposite to the first end, and a cooling system positioned within interior aspects of the generally elongated hollow airfoil. One or more cooling channels of the cooling system may have a larger cross-sectional area proximate to an end of the airfoil than at a midspan location. The cooling system may also include one or more corner blockers extending from a first end at a corner of an inner surface forming the at least one cooling channel toward a second end positioned closer to a midpoint of the at least one cooling channel in a spanwise extending direction and extending diagonally from a base at the inner surface to a tip positioned closer to a centerline axis of the at least one cooling channel.

One or more of the corner blockers may taper from the first end having a larger cross-sectional area to the second end having a smaller cross-sectional area positioned closer to the midpoint of the cooling channel. The base of the corner blocker may be in contact with the inner surface forming the cooling channel from a first end of the corner blocker to a second end of the at least one corner blocker. A cross-sectional area of the corner blocker within 25 percent of a length from the base to the tip from the tip may be larger than a cross-sectional area of the corner blocker within 25 percent of a length from the base to the tip from the base. In at least one embodiment, the corner blocker may have a rounded tip or other appropriate configuration.

In at least one embodiment, the cooling system may include two corner blockers, whereby a first corner blocker extends from a first corner on the suction side of the cooling channel and a second corner blocker extends from a second corner on the suction side of the cooling channel. The cooling system may also include two corner blockers, whereby a first corner blocker extends from a first corner on the suction side of the cooling channel and extends from a first internal rib extending from the pressure side to the suction side and a second corner blocker extends from a first corner on the pressure side of the cooling channel and extends from the first internal rib. The cooling system may also include four corner blockers, whereby a first corner blocker extends from a first corner on the suction side of the cooling channel, a second corner blocker extends from a second corner on the suction side of the cooling channel, a third corner blocker extends from a first corner on the pressure side of the cooling channel and a fourth corner blocker extends from a second corner on the pressure side of the cooling channel. One or more corner blockers may extend radially inward or radially outward. In particular, the first end of the corner blocker may be positioned at the outer diameter platform. The first end of the corner blocker may be positioned at the inner diameter platform. The cooling system may also include a leading edge cooling channel with an inlet at the outer diameter platform and an outlet at the inner diameter platform. The cooling channel of the cooling system may also include a mid-chord serpentine cooling channel extending from the outer diameter platform to the inner diameter platform with chordwise extending cooling channel legs.

The airfoil may have a bowed outer shape. In particular, the trailing edge of the airfoil may be positioned further in an upstream direction at an intersection of the trailing edge and the outer diameter platform and an intersection of the trailing edge and the inner diameter platform than a location between the inner diameter platform and the outer diameter platform. Similarly, the leading edge of the airfoil may be positioned further in an upstream direction at an intersection of the leading edge and the outer diameter platform and an intersection of the leading edge and the inner diameter platform than a location between the inner diameter platform and the outer diameter platform.

An advantage of the cooling system is that the cooling system works exceptionally well to cool bow shaped airfoils that typically have cooling channels having reduced volumes in the mid-span region as compared to portions of the cooling channel at the inboard or outboard ends outside of the mid-span regions.

Another advantage of the cooling system is that use of one or more corner blockers avoids a drastic reduction of channel flow Mach number, which may induce cooling flow diffusion or in some cases, may induce flow separation within the serpentine flow.

Still another advantage of the cooling system is that by incorporating one or more corner blockers into the inner or outer portions of the serpentine cooling channels, or both, where the serpentine channel flow area becomes too large to maintain the through flow channel Mach number, the diffusion problem for a low mass flux at the inner and outer diameter platforms can be eliminated.

Another advantage of the cooling system is that the arrangement of corner blockers described herein may eliminate the cooling flow mal-distribution commonly found in low mass flux flow channels and instead push the cooling air toward the inner side of the airfoil wall and boost the flow channel through flow velocity, thereby increasing the channel heat transfer enhancement.

Yet another advantage of the cooling system is that sizing of the corner blocker may be customized to achieve a constant cooling flow channel cross-sectional area within all or a portion of the cooling channel.

Another advantage of this invention is that the serpentine cooling channels yield higher cooling effectiveness levels than conventionally drilled radial hole cooling designs.

Still another advantage of this invention is that the triple pass serpentine cooling channels yields a lower and more uniform blade sectional mass average temperature for the blade lower span, which improves blade creep life capability.

These and other embodiments are described in more detail below.

BRIEF DESCRIPTION OF THE DRAWINGS

The accompanying drawings, which are incorporated in and form a part of the specification, illustrate embodiments of the presently disclosed invention and, together with the description, disclose the principles of the invention.

DETAILED DESCRIPTION OF THE INVENTION

Figure 2:
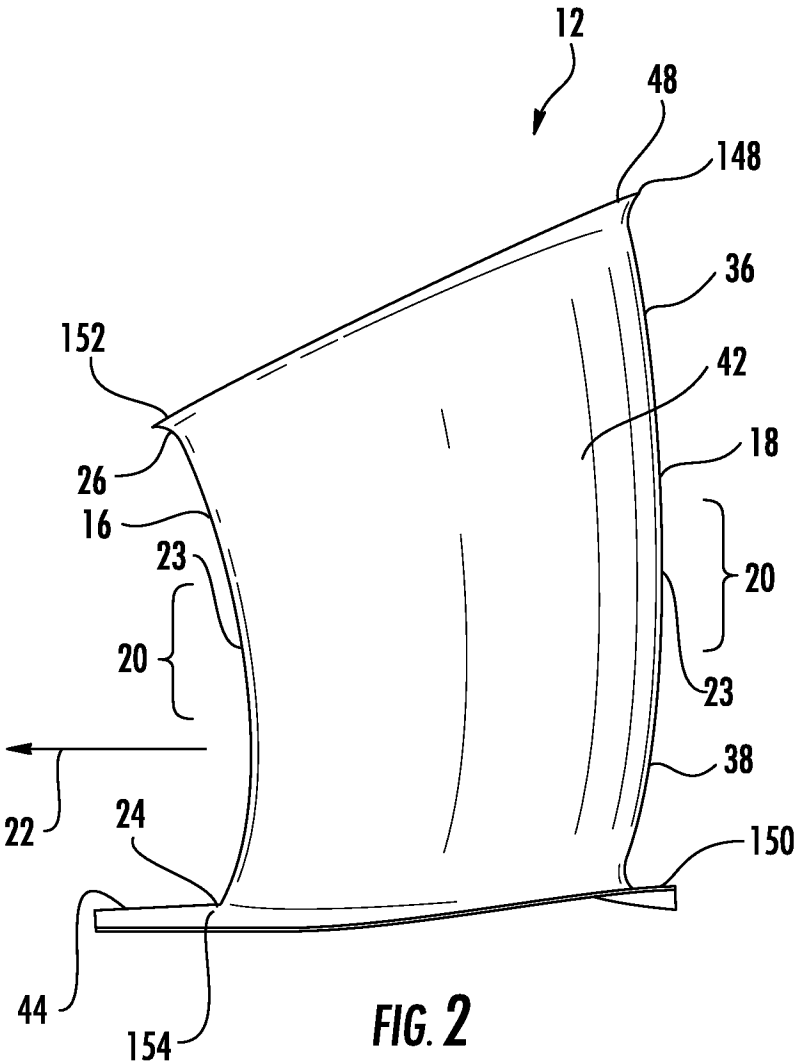
FIG. 2 is a side view of a bow shaped vane usable in a gas turbine engine.
Figure 1:
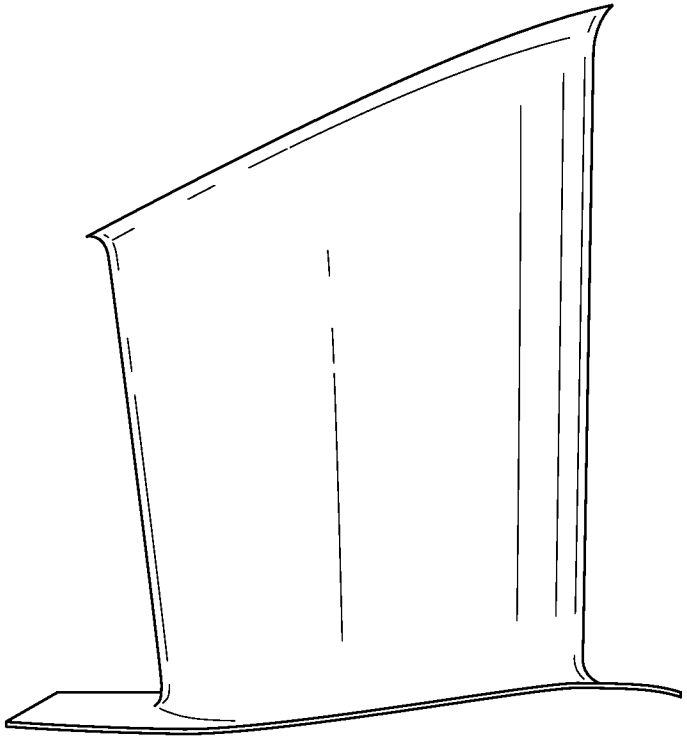
FIG. 1 is a side view of a conventional vane usable in a gas turbine engine.
Figure 4:
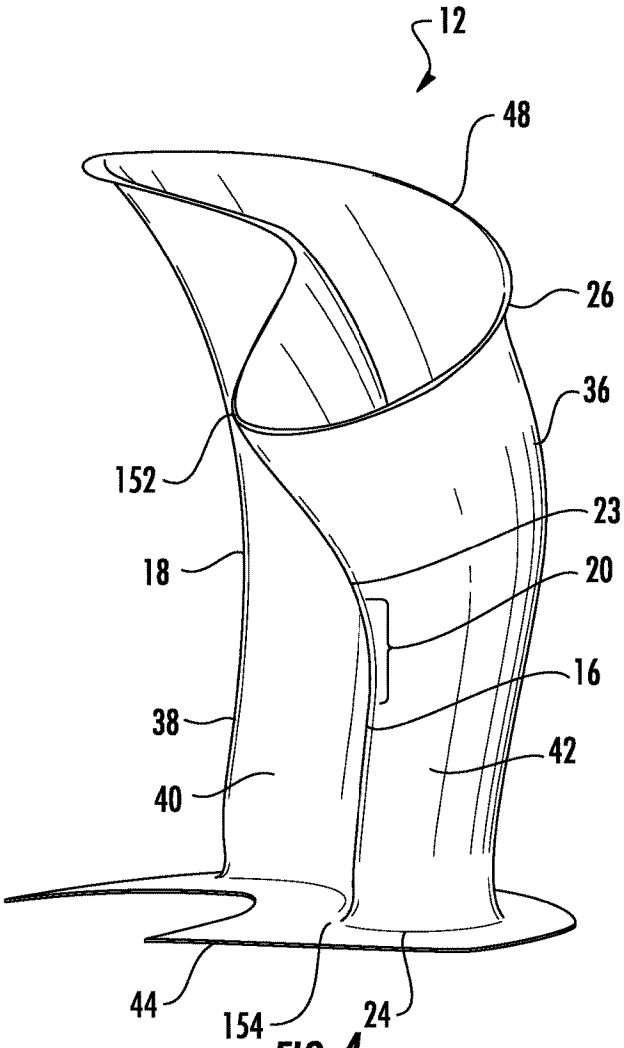
FIG. 4 is a front view of a bow shaped vane of FIG. 2 usable in a gas turbine engine.
Figure 3:
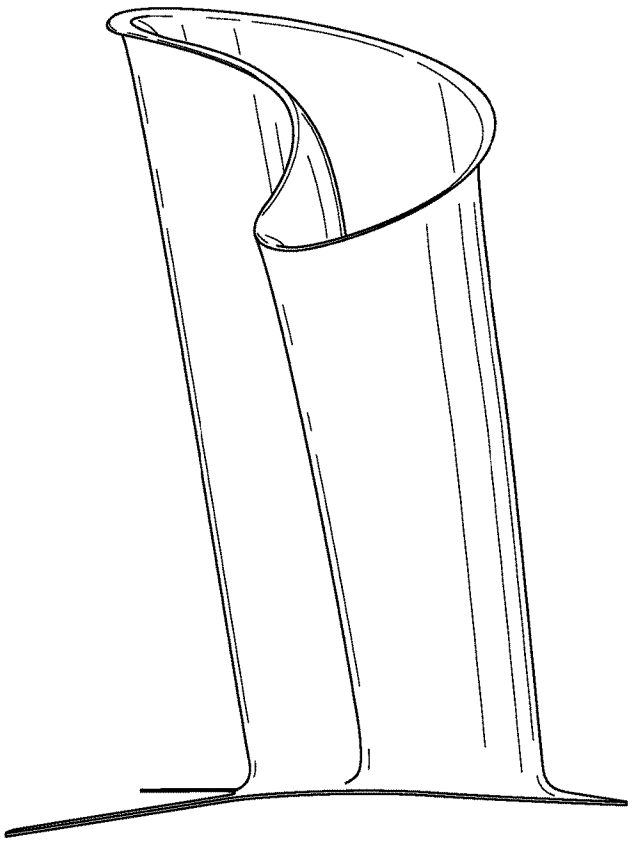
FIG. 3 is a front view of the conventional vane of FIG. 1 usable in a gas turbine engine.
Figure 5:
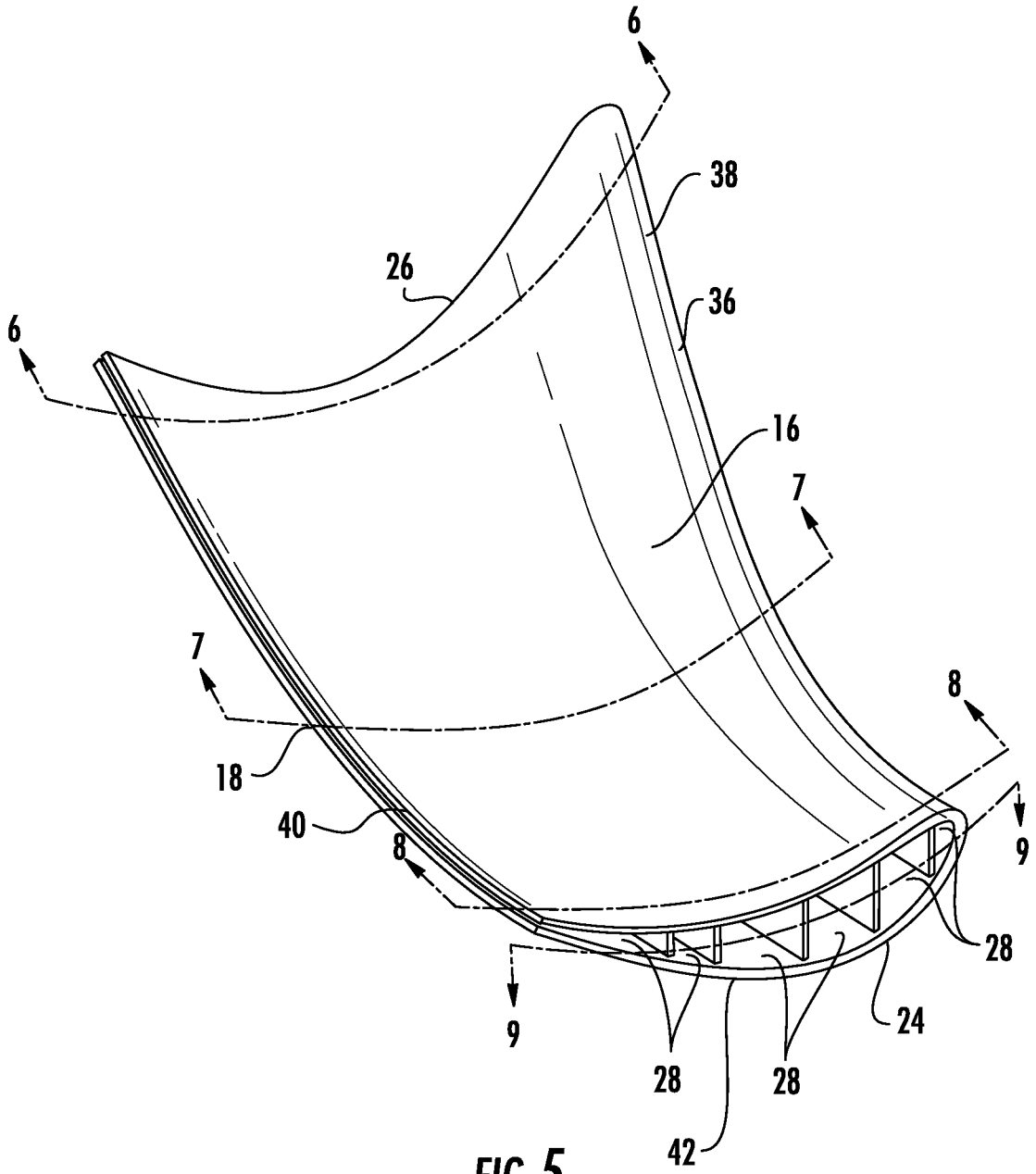
FIG. 5 is a perspective view of the bow shaped vane of FIG. 2.

As shown in FIGS. 1-12, a cooling system 10 for a turbine airfoil 12 of a gas turbine engine, wherein the turbine airfoil 12 has a bowed configuration is disclosed. The turbine airfoil 12 may be configured such that the leading edge 16 or trailing edge 18, or both, may have outer ends, 24, 26 that are positioned further in an upstream direction 22 than midsections 20 of the leading and trailing edges 16, 18, as shown in FIGS. 2, 4 and 5. One or more cooling channels 28 of the cooling system 10, as shown in FIGS. 6-8, 10 and 11, may have a larger cross-sectional area proximate to an end 24, 26 of the airfoil 12 than at a midspan location 20. One or more cooling channels 28 may have one or more corner blockers 30 that extend chordwise in the cooling channel 10 and extend from a corner 32 toward a centerline axis 34, thereby reducing a cross-sectional area of the cooling channel 28. The corner blockers 30 may be positioned within the cooling system 10 to maintain the flow of cooling fluids through the airfoil 12 within desired design parameters.

In at least one embodiment, as shown in FIGS. 2, 4, 5 and 10, the turbine airfoil 12 may be formed from a generally elongated hollow airfoil 36 formed from an outer wall 38, and having a leading edge 16, a trailing edge 18, a pressure side 40, a suction side 42, an inner diameter platform 44 at a first end 24 of the turbine airfoil 12 and an outer diameter platform 48 at a second end 26 opposite to the first end 24, and the cooling system 10 positioned within interior aspects of the generally elongated hollow airfoil 36. One or more cooling channels 28 of the cooling system 10 may have a larger cross-sectional area proximate to an end 24, 26 of the airfoil 36 than at a midspan location 20. In at least one embodiment, the walls forming the cooling channels 28 may be positioned closer together in the midspan location 20 of the airfoil. One or more corner blockers 30 may extend from a first end 52 at a corner 54 of an inner surface 56 forming the cooling channel 28 toward a second end 58 positioned closer to a midpoint 60 of the cooling channel 28 in a spanwise extending direction 62 and extending diagonally from a base 64 at the inner surface 56 to a tip 66 positioned closer to the centerline axis 34 of the cooling channel 28.

Figure 6:
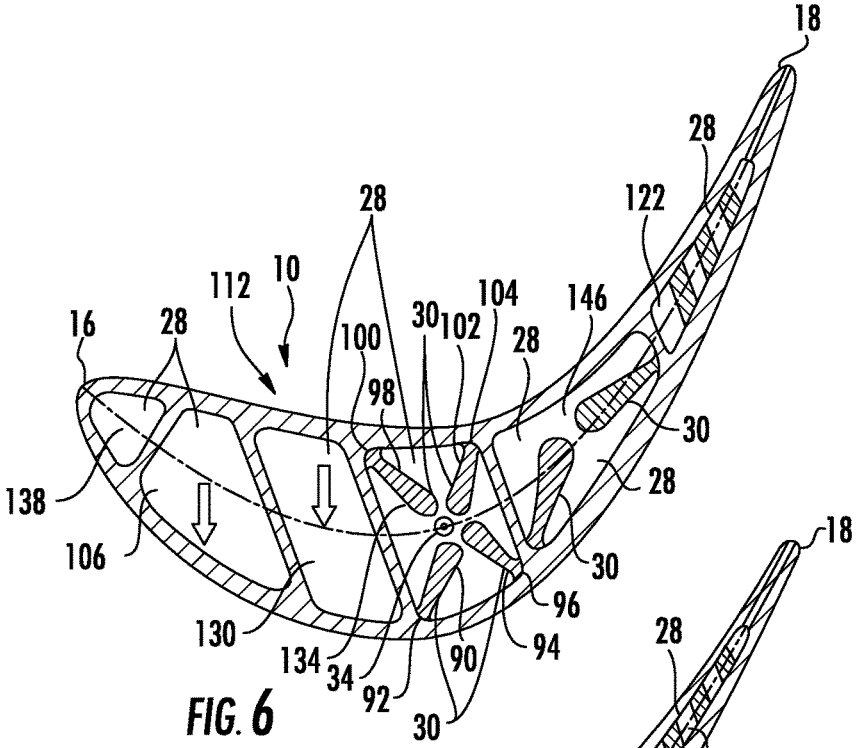
FIG. 6 is a cross-sectional view of the bow shaped vane of FIG. 2 taken along section line 6-6 in FIG. 5.
Figure 7:
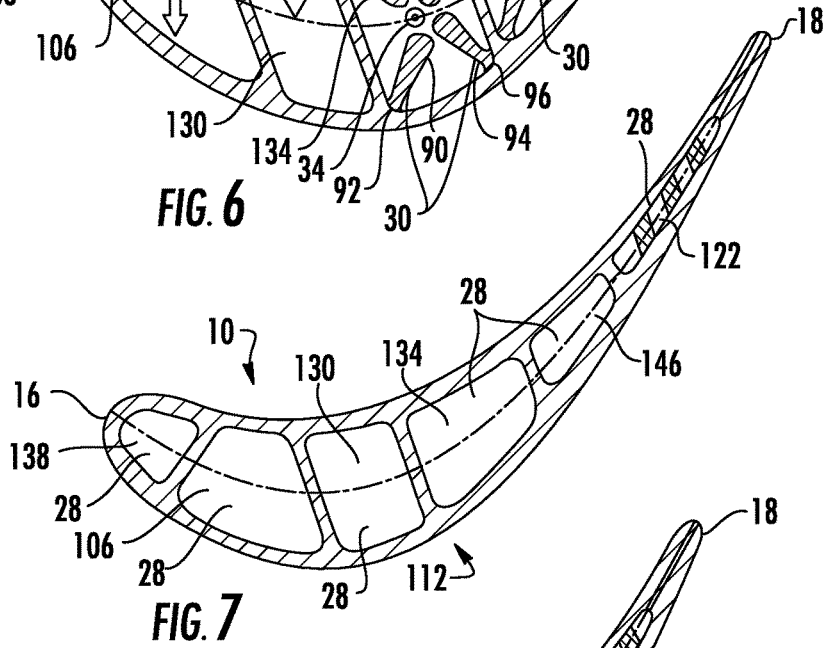
FIG. 7 is a cross-sectional view of the bow shaped vane of FIG. 2 taken along section line 7-7 in FIG. 5.
Figure 8:
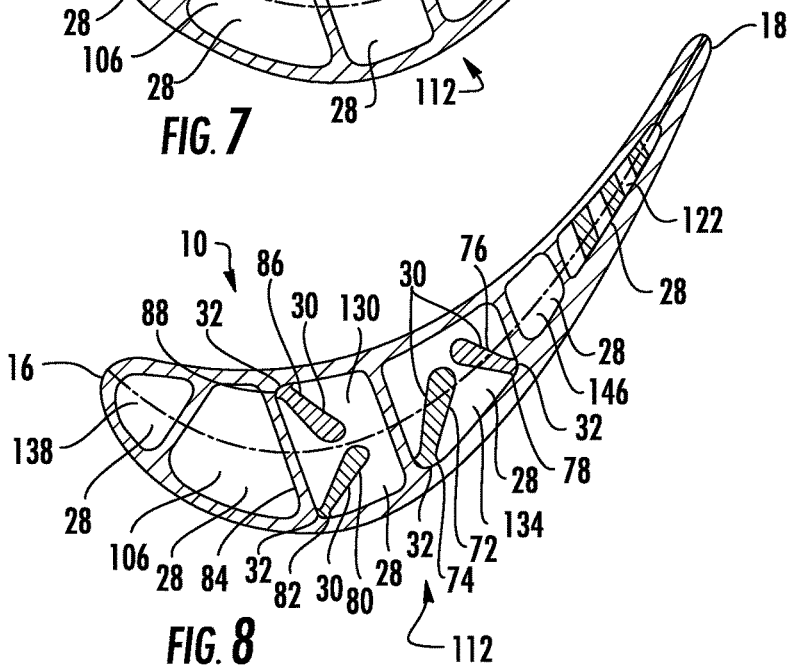
FIG. 8 is a cross-sectional view of the bow shaped vane of FIG. 2 taken along section line 8-8 in FIG. 5.
Figure 10:
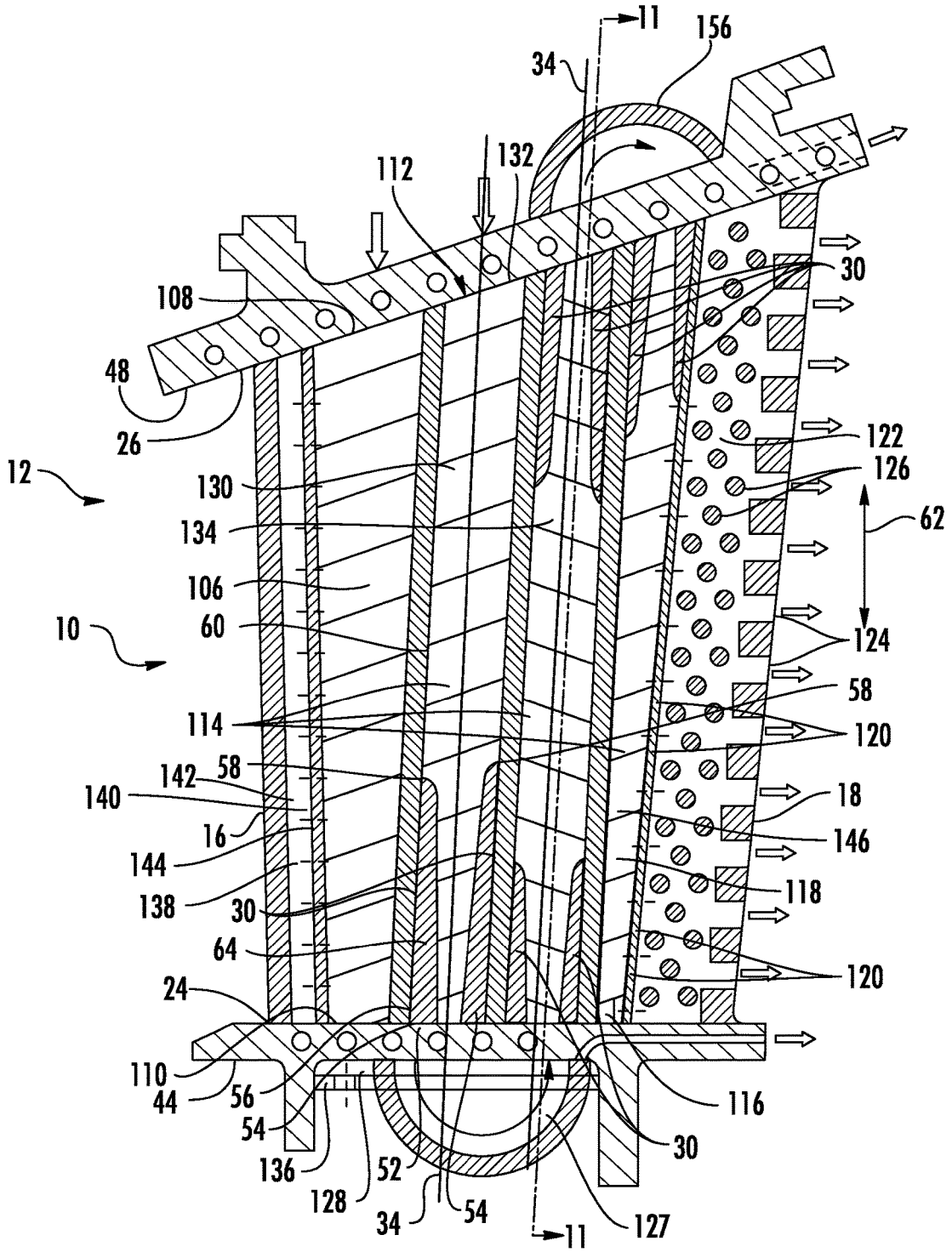
FIG. 10 is a cross-sectional view of the turbine vane taken along section line 9-9 in FIG. 5.
Figure 12:
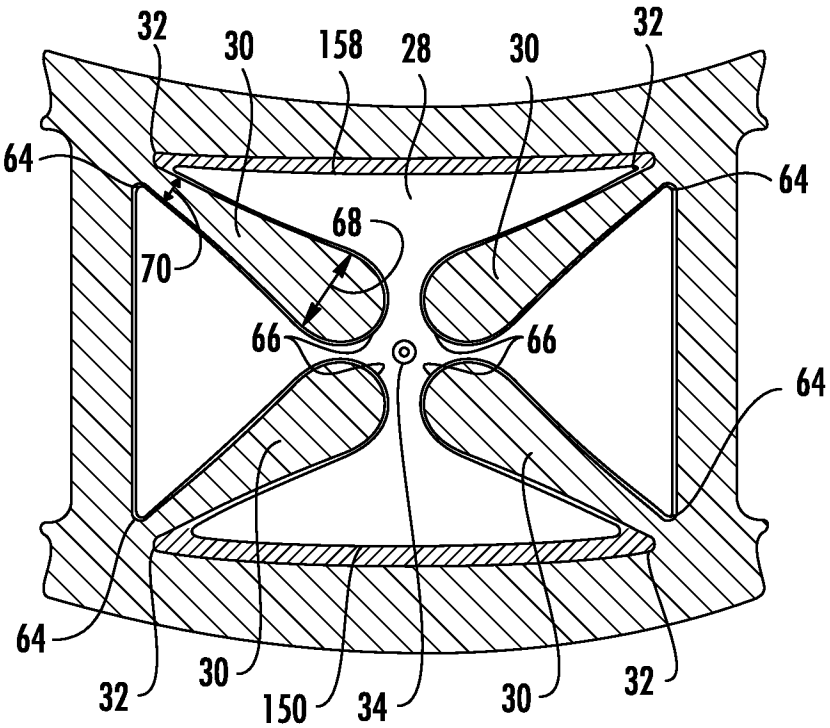
FIG. 12 is a cross-sectional view of a cooling channel within the turbine vane taken along section line 13-13 in FIG. 11.
Figure 11:
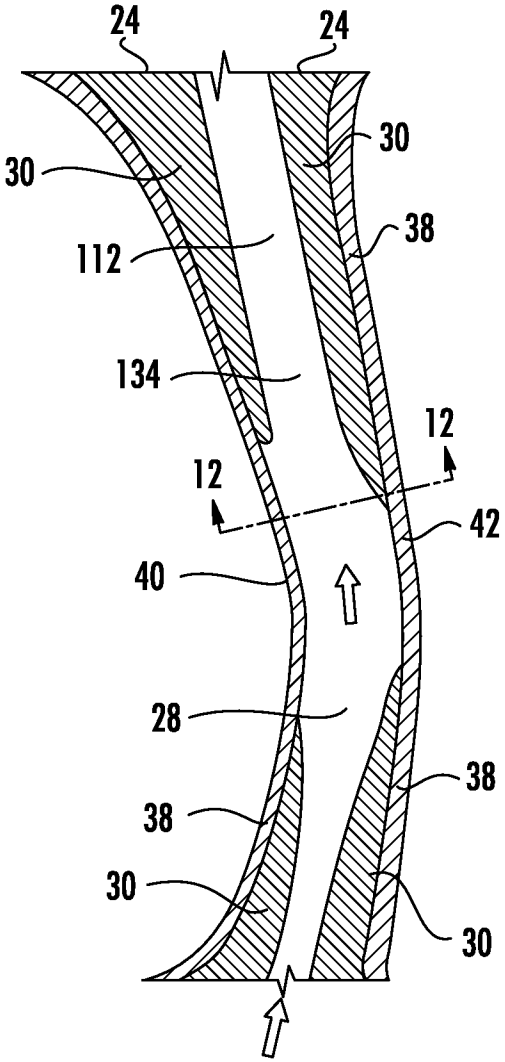
FIG. 11 is a cross-sectional view of the turbine vane taken along section line 11-11 in FIG. 10.

As shown in FIGS. 10 and 11, the corner blocker 30 may taper from the first end 52 having a larger cross-sectional area to the second end 58 having a smaller cross-sectional area positioned closer to the midpoint 60 of the cooling channel 28. The base 64 of the corner blocker 30 may be in contact with the inner surface 56 forming the cooling channel 28 from the first end 52 of the corner blocker 30 to the second end 58 of the corner blocker 30. As shown in FIG. 12, a cross-sectional area 68 of the corner blocker 30 within 25 percent of a length from the base 64 to the tip 66 from the tip 66 may be larger than a cross-sectional area 70 of the corner blocker 30 within 25 percent of a length from the base 64 to the tip 66 from the base 64. In at least one embodiment, the corner blocker 30 may have a rounded tip 66 or other appropriate shape. As shown in FIGS. 6 and 8, the cooling system 10 may include two corner blockers 30. A first corner blocker 72 may extend from a first corner 74 on the suction side 42 of the cooling channel 28 and a second corner blocker 76 may extend from a second corner 78 on the suction side 42 of the cooling channel 28. As shown in FIG. 8, the cooling system 10 may include two corner blockers 30. A first corner blocker 80 may extend from a first corner 82 on the suction side 42 of the cooling channel 28 and may extend from a first internal rib 84 extending from the pressure side 40 to the suction side 42. A second corner blocker 86 may extend from a first corner 88 on the pressure side 40 of the cooling channel 28 and may extends from the first internal rib 84. In yet another embodiment, as shown in FIGS. 6 and 12, the cooling system 10 may include four corner blockers 30. A first corner blocker 90 may extend from a first corner 92 on the suction side 42 of the cooling channel 28. A second corner blocker 94 may extend from a second corner 96 on the suction side 42 of the cooling channel 28. A third corner blocker 98 may extend from a first corner 100 on the pressure side 40 of the cooling channel 28, and a fourth corner blocker 102 may extend from a second corner 104 on the pressure side 40 of the cooling channel 28. In at least one embodiment, the first end 24 of the corner blocker 30 may be positioned at the outer diameter platform 48. The first end 24 of the corner blocker 30 may be positioned at the inner diameter platform 44.

Figure 9:
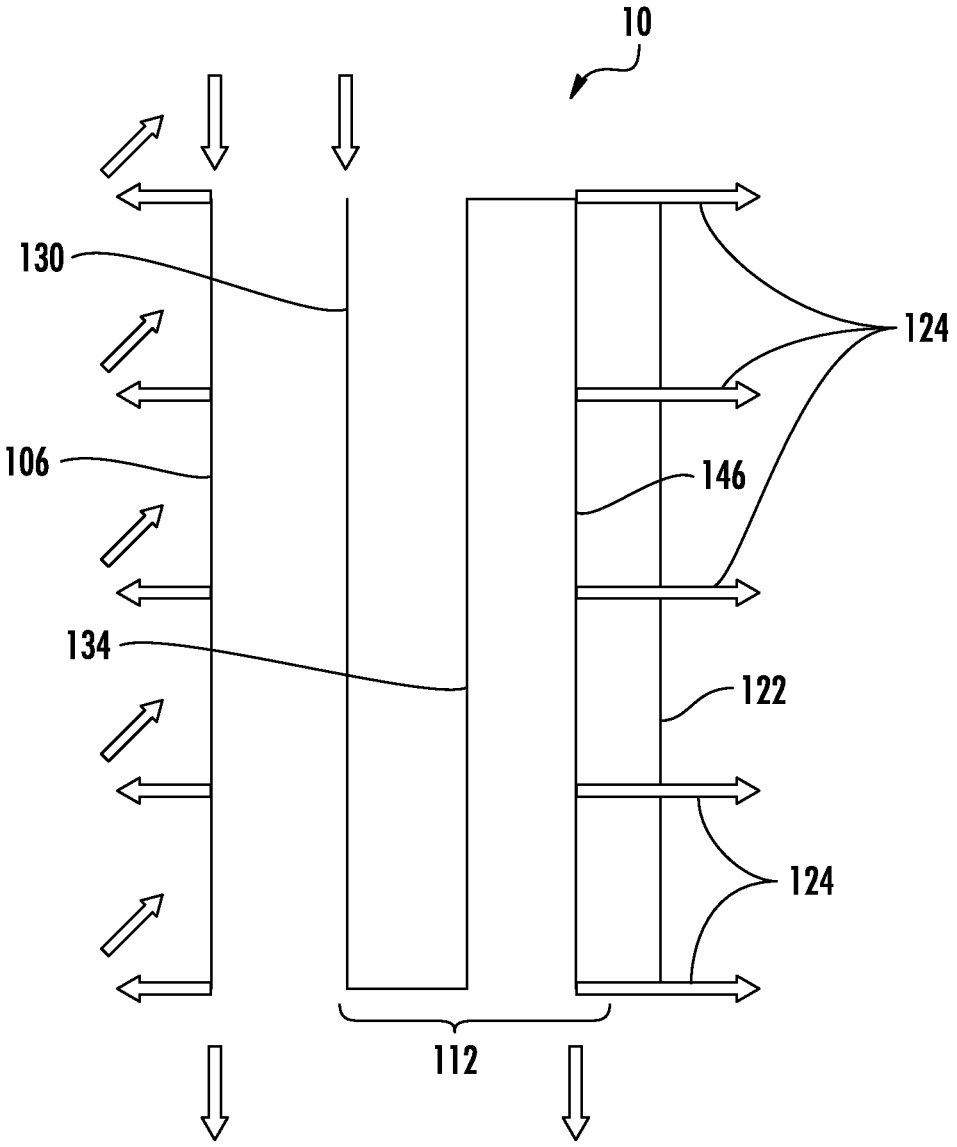
FIG. 9 is a schematic diagram of a cooling system within the turbine vane.

As shown in FIGS. 6-8 and 10, the cooling system 10 may include a leading edge cooling channel 106 with an inlet 108 at the outer diameter platform 48 and an outlet 110 at the inner diameter platform 44. The cooling system 10 may also include a mid-chord serpentine cooling channel 112 extending from the outer diameter platform 48 to the inner diameter platform 44 with chordwise extending cooling channel legs 114. In at least one embodiment, the mid-chord serpentine cooling channel 112 may be a triple pass serpentine cooling channel 112, as shown in FIGS. 9 and 10. The inlet 108 may be positioned at the outer diameter platform 48. The mid-chord serpentine cooling channel 112 may include an outlet 110 at an end 116 of a last leg 118 at the outer diameter platform 48. The mid-chord serpentine cooling channel 112 may also include a plurality of exhaust outlets 120 in the last leg 118 of the mid-chord serpentine cooling channel 112 extending chordwise between the outer diameter platform 48 to the inner diameter platform 44. The exhaust outlets 120 in the last leg 118 of the mid-chord serpentine cooling channel 112 may be in communication with a trailing edge cooling channel 122. The trailing edge cooling channel 122 may include one or more exhaust outlets 124. In at least one embodiment, the trailing edge cooling channel 122 may include a plurality of exhaust outlets 124 extending chordwise between the outer diameter platform 48 to the inner diameter platform 44. The trailing edge cooling channel 122 may also include one or more pin fins 150 extending from the pressure side 40 to the suction side 42.

As shown in FIG. 10, the cooling system 10 may include an inboard impingement chamber 128 in fluid communication with the leading edge cooling channel 106. In particular, the outlet 110 of the leading edge cooling channel 106 may exhaust cooling fluid into the inboard impingement chamber 128. The inboard impingement chamber 128 may be formed from an impingement rib 136 positioned inboard of the leading edge cooling channel 106. In at least one embodiment, the inboard impingement chamber 128 may be positioned inboard of the inner diameter platform 44. In at least one embodiment, the inboard impingement chamber 128 may be an inter-stage seal housing (ISSH). Air from the ISSH may be used to purge the front and aft rim cavities and mat-face gap.

A first leg 130 of the mid-chord serpentine cooling channel 112 may exhaust cooling fluid into an inboard turn 127. An inlet 132 of a second leg 134 of the mid-chord serpentine cooling channel 112 may be in communication with the inboard turn 127 such that the inboard turn 127 supplies cooling fluid to the second leg 134.

The leading edge cooling channel 106 may also include a leading edge impingement chamber 138 formed by one or more impingement plates 140 positioned within the leading edge cooling channel 106 to provide impingement cooling to an inner surface 142 of the outer wall 38 forming the leading edge 16. The impingement plate 140 may extend spanwise within the leading edge cooling channel 106. In at least one embodiment, the impingement plate 140 may extend spanwise from the inner diameter platform 44 to the outer diameter platform 48. The impingement plate 140 may include one or more impingement orifices 144. In at least one embodiment, the impingement plate 140 may include a plurality of impingement orifices 144 extending chordwise from the inner diameter platform 44 to the outer diameter platform 48.

In at least one embodiment, the cooling system 10 may include a triple pass mid-chord serpentine cooling channel 112 formed from first, second and third legs 130, 134, 146. The first leg 130 may include two corner blockers 30 extending from the inner diameter platform 44. A first corner blocker 80 may extends from a first corner 82 on the suction side 42 of the cooling channel 28 and may extend from a first internal rib 84 extending from the pressure side 40 to the suction side 42. A second corner blocker 86 may extend from a first corner 88 on the pressure side 40 of the cooling channel 28 and may extend from the first internal rib 84. The second leg 134 may include two corner blockers 30 extending from the inner diameter platform 44. A first corner blocker 72 may extend from a first corner 74 on the suction side 42 of the cooling channel 28. A second corner blocker 76 may extend from a second corner 78 on the suction side 42 of the second leg 134 of the cooling channel 28. The second leg 134 may also include four corner blockers 30 at the outer diameter platform 48. In particular, a first corner blocker 90 may extend from a first corner 92 on the suction side 42 of the third leg 146 of the cooling channel 28. A second corner blocker 94 may extend from a second corner 96 on the suction side 42 of the third leg 146 of the cooling channel 28. A third corner blocker 98 may extend from a first corner 100 on the pressure side 40 of the third leg 146 of the cooling channel 28. A fourth corner blocker 102 may extend from a second corner 104 on the pressure side 40 of the third leg 146 of the cooling channel 28. The first, second, third and fourth corner blockers 90, 94, 98 and 102 at the outer diameter platform 48 in the second leg 134 may each extend from base 64 to tip 66 toward the centerline axis 34. As such, first and fourth corner blockers 90, 102 may be aligned with each other, and second and third corner blockers 94, 98 may be aligned with each other. The third leg 146 may include two corner blockers 30 extending from the inner diameter platform 44. A first corner blocker 72 may extend from a first corner 74 on the suction side 42 of the cooling channel 28. A second corner blocker 76 may extend from a second corner 78 on the suction side 42 of the third leg 146 of the cooling channel 28.

The cooling system may also include one or more trip strips 158, as shown in FIG. 12. The trip strips 158 may have any appropriate configuration and be used in any pattern or alignment. The trip strips 158 may be formed from any appropriate material and may be positioned in one or more of the cooling channels 28.

The airfoil 12 may have a bowed shape, as shown in FIGS. 2, 4 and 5. As such, the trailing edge 18 of the airfoil 36 may be positioned further in the upstream direction 22 at an intersection 148 of the trailing edge 18 and the outer diameter platform 48 and an intersection 150 of the trailing edge 18 and the inner diameter platform 44 than a location 23 between the inner diameter platform 44 and the outer diameter platform 48. Similarly, the leading edge 16 of the airfoil 36 may be positioned further in the upstream direction 22 at an intersection 152 of the leading edge 16 and the outer diameter platform 48 and an intersection 154 of the leading edge 16 and the inner diameter platform 44 than a location 23 between the inner diameter platform 44 and the outer diameter platform 48.

During use, cooling fluids may flow into the cooling system 10 from a cooling fluid supply source through the inlet 108 of the leading edge cooling channel 106. As least a portion of the cooling fluids may flow through the impingement plate 140 into the leading edge impingement chamber 138. The cooling fluids may flow through the leading edge cooling channel 106 and may be exhausted through the outlet 110 into the inboard impingement chamber 128. The cooling fluids may also enter the first leg 130 of the mid-chord serpentine cooling channel 112 at the outer diameter platform 48 and flow through to the inboard turn 127 and into the second leg 134 where the cooling fluids flow radially outward in the second leg 134. The cooling fluid may flow into the outboard turn 156 and into the third leg 146. The cooling fluid may flow radially inward to the inner diameter platform 44 and through the exhaust outlets 120 into the trailing edge cooling channel 122. The cooling fluids may contact the pin fins 150 and may be exhausted through the exhaust outlets 124 in the trailing edge 16.

For the triple pass mid-chord serpentine cooling channel 112, a cross-sectional area of the first leg 130 may contract moving the outer diameter platform 48 toward the mid-span region. As such, the cooling flow accelerates from the outer diameter platform 48 to the mid-span region, which yields a positive channel flow Mach number. A cross-sectional area of the first leg 130 expands moving from the mid-span region to the inner diameter platform 44. As such, the cooling flow decelerates from the mid-span region to the outer diameter platform 48, which yields a negative channel flow Mach number. For the second leg 134 of the mid-chord serpentine cooling channel 112, the channel flow Mach number will increase moving towards the mid-span region and then will decrease moving from the mid-span region to the outer diameter platform 48 due to flow contraction and then flow diffusion. In the second leg 134 between the mid-span region and the outer diameter platform 48, the Mach number may be reduce from 0.15 to 0.05 in a short distance. A negative Mach number of 0.10 is thus created for a short channel flow distance. This drastic reduction of channel flow Mach number may induce cooling flow diffusion or in some cases, will induce flow separation within the serpentine flow channel 112.

The diffusion problem for a low mass flux at the inner and outer diameter platforms 44, 48 can be resolved by incorporating one or more corner blockers 30 into the inner or outer portions of the serpentine cooling channels 112, or both, where the serpentine channel flow area becomes too large to maintain the through flow channel Mach number. As shown in FIGS. 6-8, 10 and 11, the second leg 134 of the mid-chord serpentine cooling channel 112 includes a plurality of corner blockers 30. One or more of the corner blockers 30 may include a tapered cross-sectional area from the outer diameter platform 48 toward the mid-span region or from the inner diameter platform 44 toward the mid-span region. The corner blockers 30 may have an increasing cross-sectional area moving the base 64 to the tip 66. As such, the corner blockers 30 may appear to be narrow at the base 64 and broader at the tip 66.

In at least one embodiment, as shown in FIGS. 6-8, 10 and 12, the cooling system 10 may include four corner blockers 30 at each corner of a cooling channel 28. The corner blockers 30 may conduct heat away from the airfoil 36, thereby lowering the thermal gradient at the junction of the internal rib 84 and the outer wall 38. In addition, in at least one embodiment, corner blockers 30 may not be attached to the outer or inner diameter platforms 44, 48, and thus, the first end 52 may be free to move relative to each other. The larger cross-sectional area of the corner blockers 30 at the tips 66 in the middle of the cooling channel 28 may direct cooling fluid toward the airfoil hot outer wall 38, thereby obtaining better utilization of the cooling fluid. Sizing of the corner blocker 30 may be customized to achieve a constant cooling flow channel cross-sectional area within all or a portion of the cooling channel 28. The cooling system 10 set forth herein eliminates the diffusion issue discussed above and creates high through flow channel velocity at the airfoil outer diameter platform 48 and inner diameter platform 44, thus generating a high rate of internal convective heat transfer coefficient and improvement in overall cooling performance. The corner blocker 30 also creates more internal convection surface area within the cooling channel 28 and within the mid-chord serpentine cooling channel 112. Because the size of the corner blocker 30 can be varied along the cooling channel 28, the cooling system 10 may be adapted for future growth to add more cooling capacity, as needed.

In at least one embodiment, the configuration of the cooling system 10 with corner blockers 30 may be constructed through the use of a pint parts manufacturing technique. Because the corner blockers 30 are not in the same direction parallel to the airfoil internal ribs, it is impossible to produce a ceramic core for this complicated cooling geometry disclosed herein via ceramic core die. With the print parts manufacturing technique, a ceramic core can be printed and then used to create the airfoil 12 with the cooling system 10 with corner blockers 30. Alternatively, the airfoil 12 with the cooling system 10 with corner blockers 30 can be printed from one or more metals.

The corner blockers 30 may be positioned at a different angle than the internal rib 84 within the cooling channel 28. There is no need to chamfer the internal rib 84 by three degrees to five degrees or line up the internal ribs 84 to be parallel to be able to pull a core die. The arrangement of corner blockers 30 described herein may eliminate the cooling flow mal-distribution commonly found in low mass flux flow channels and instead, push the cooling air toward the inner side of the airfoil wall and boost the flow channel through flow velocity, thereby increasing the channel heat transfer enhancement.

The foregoing is provided for purposes of illustrating, explaining, and describing embodiments of this invention. Modifications and adaptations to these embodiments will be apparent to those skilled in the art and may be made without departing from the scope or spirit of this invention.

I claim:

1. A turbine airfoil (12), characterized in that:

a generally elongated hollow airfoil (36) formed from an outer wall (38), and having a leading edge (16), a trailing edge (18), a pressure side (40), a suction side (42), an inner diameter platform (44) at a first end (46)

of the airfoil (36) and an outer diameter platform (48) at a second end (50) opposite to the first end (46), and a cooling system (10) positioned within interior aspects of the generally elongated hollow airfoil (36);

at least one cooling channel (28) of the cooling system (10) having a larger cross-sectional area proximate to an end of the airfoil (36) than at a midspan location; and at least one corner blocker (30) extending from a first end (52) at a corner (54) of an inner surface (56) forming the at least one cooling channel (28) toward a second end (58) positioned closer to a midpoint (60) of the at least one cooling channel (28) in a spanwise extending direction and extending diagonally from a base (64) at the inner surface (56) to a tip (66) positioned closer to a centerline axis (34) of the at least one cooling channel (28).

2. The turbine airfoil (12) of claim 1, characterized in that the at least one corner blocker (30) tapers from the first end (52) having a larger cross-sectional area to the second end (58) having a smaller cross-sectional area positioned closer to the midpoint (60) of the at least one cooling channel (28).

3. The turbine airfoil (12) of claim 1, characterized in that the base (64) of the at least one corner blocker (30) is in contact with the inner surface (56) forming the at least one cooling channel (28) from a first end (52) of the at least one corner blocker (30) to a second end (58) of the at least one corner blocker (30).

4. The turbine airfoil (12) of claim 1, characterized in that a cross-sectional area of the at least one corner blocker (30) within 25 percent of a length from the base (64) to the tip (66) from the tip (66) is larger than a cross-sectional area of the at least one corner blocker (30) within 25 percent of a length from the base (64) to the tip (66) from the base (64).

5. The turbine airfoil (12) of claim 1, characterized in that the at least one corner blocker (30) has a rounded tip (66).

6. The turbine airfoil (12) of claim 1, characterized in that the at least one corner blocker (30) comprises two corner blockers (30), wherein a first corner (72) blocker extends from a first corner (74) on the suction side (42) of the at least one cooling channel (28) and a second corner blocker (76) extends from a second corner (78) on the suction side (42) of the at least one cooling channel (28).

7. The turbine airfoil (12) of claim 1, characterized in that the at least one corner blocker (30) comprises two corner blockers (30), wherein a first corner blocker (80) extends from a first corner (82) on the suction side (42) of the at least one cooling channel (28) and extends from a first internal rib (84) extending from the pressure side (40) to the suction side (42) and a second corner blocker (86) extends from a first corner (88) on the pressure side (40) of the at least one cooling channel (28) and extends from the first internal rib (84).

8. The turbine airfoil (12) of claim 1, characterized in that the at least one corner blocker (30) comprises four corner blockers (30), wherein a first corner blocker (90) extends from a first corner (92) on the suction side (42) of the at least one cooling channel (28), a second corner blocker (94) extends from a second corner (96) on the suction side (42) of the at least one cooling channel (28), a third corner blocker (98) extends from a first corner (100) on the pressure side (40) of the at least one cooling channel (28) and a fourth corner blocker (102) extends from a second corner (104) on the pressure side (40) of the at least one cooling channel (28).

9. The turbine airfoil (12) of claim 1, characterized in that the first end (52) of the at least one corner blocker (30) is positioned at the outer diameter platform (48).

10. The turbine airfoil (12) of claim 1, characterized in that the first end (52) of the at least one corner blocker (30) is positioned at the inner diameter platform (44).

11. The turbine airfoil (12) of claim 1, characterized in that the at least one cooling channel (28) of the cooling system (10) comprises a leading edge cooling channel (106) with an inlet (108) at the outer diameter platform (48) and an outlet (110) at the inner diameter platform (44).

12. The turbine airfoil (12) of claim 11, characterized in that the at least one cooling channel (28) of the cooling system (10) comprises a mid-chord serpentine cooling channel (112) extending from the outer diameter platform (48) to the inner diameter platform (44) with chordwise extending cooling channel legs (114).

13. The turbine airfoil (12) of claim 1, characterized in that the trailing edge (18) of the airfoil (36) is positioned further in an upstream direction at an intersection (148) of the trailing edge (18) and the outer diameter platform (48) and an intersection (150) of the trailing edge (18) and the inner diameter platform (44) than a location between the inner diameter platform (44) and the outer diameter platform (48).

14. The turbine airfoil (12) of claim 13, characterized in that the leading edge (16) of the airfoil (36) is positioned further in an upstream direction at an intersection (152) of the leading edge (16) and the outer diameter platform (48) and an intersection (154) of the leading edge (16) and the inner diameter platform (44) than a location between the inner diameter platform (44) and the outer diameter platform (48).

* * * * *